US012721459B2

(12) United States Patent
Hobbs

(10) Patent No.: US 12,721,459 B2
(45) Date of Patent: Sep. 1, 2026

(54) DEVICE FOR COOLING TREATMENT

(71) Applicant: Jared S. Hobbs, Vancouver, WA (US)

(72) Inventor: Jared S. Hobbs, Vancouver, WA (US)

( * ) Notice: Subject to any disclaimer, the term of this patent is extended or adjusted under 35 U.S.C. 154(b) by 21 days.

(21) Appl. No.: 18/629,433

(22) Filed: Apr. 8, 2024

(65) Prior Publication Data

US 2025/0311868 A1 Oct. 9, 2025

(51) Int. Cl.
*A47G 9/10* (2006.01)
*A47G 9/00* (2006.01)

(52) U.S. Cl.
CPC ..... *A47G 9/1036* (2013.01); *A47G 2009/001* (2013.01); *A47G 2009/1018* (2013.01)

(58) Field of Classification Search
CPC ..... B68G 1/00; A47G 9/1036; A47G 9/1009; A47G 2009/1018; A47G 9/1027; A47G 9/10; A47G 9/1054; A47G 9/1063; A47G 9/1072; A47G 9/1081; A47G 9/109
USPC ..... 5/490, 421, 636, 644, 484, 485, 640
See application file for complete search history.

(56) References Cited

U.S. PATENT DOCUMENTS

| | | | | |
|---|---|---|---|---|
| 5,194,311 | A * | 3/1993 | Baymak | B68G 1/00 428/116 |
| 2003/0028971 | A1* | 2/2003 | Chaffee | A47G 9/062 5/710 |
| 2016/0066716 | A1* | 3/2016 | Rao | A61B 5/6814 600/26 |
| 2016/0324720 | A1* | 11/2016 | Lear | A61H 23/02 |
| 2017/0055737 | A1* | 3/2017 | Rochlin | A47G 9/10 |
| 2022/0330732 | A1* | 10/2022 | Maeda | A47G 9/1036 |
| 2023/0389732 | A1* | 12/2023 | Yu | A47G 9/1036 |

* cited by examiner

*Primary Examiner* — Justin C Mikowski
*Assistant Examiner* — Deborah Talitha Gedeon
(74) *Attorney, Agent, or Firm* — The Rapacke Law Group, P.A.; Andrew S. Rapacke; Kenneth F. Brooks

(57) ABSTRACT

A device for cooling treatment can include a cooling pack; a cushion including a cavity, the cavity being constructed and arranged to accommodate the cooling pack; at least one reattachable layer of material disposed over the cooling pack and the cavity wherein: the cooling pack is positioned within the cavity, the cooling pack is removable from the cavity the at least one reattachable layer of material disposed over the cooling pack has a thickness of at least 3 mm; and the cavity of the cushion has a depth of at least 12 mm.

20 Claims, 6 Drawing Sheets

DEVICE FOR COOLING TREATMENT

TECHNICAL FIELD

The embodiments generally relate to the field of devices for cooling treatment.

BACKGROUND

Cooling treatment devices generally are not able to maintain a low temperature for an extended period of time such as four to eight hours. Such cooling treatment devices are often too cold for sensitive skin, and especially too cold for a user's face.

There is a need for a cooling treatment device that can maintain a low temperature (e.g., 30° C.-50° C.) for an extended period of time without burning a user's skin. The cooling treatment device can be used at least for reducing fevers, alleviating migraines, or reducing inflammation. The cooling treatment device can also be used for cooling a user's body during warmer weather.

SUMMARY

This summary is provided to introduce a variety of concepts in a simplified form that is further disclosed in the detailed description of the embodiments. This summary is not intended to identify key or essential inventive concepts of the claimed subject matter, nor is it intended for determining the scope of the claimed subject matter.

In general, the disclosed device for cooling treatment can include a cooling pack; a cushion including a cavity, the cavity being constructed and arranged to accommodate the cooling pack; at least one reattachable layer of material disposed over the cooling pack and the cavity wherein: the cooling pack is positioned within the cavity, the cooling pack is removable from the cavity the at least one reattachable layer of material disposed over the cooling pack has a thickness of at least 3 mm; and the cavity of the cushion has a depth of at least 12 mm.

Other illustrative variations within the scope of the invention will become apparent from the detailed description provided hereinafter. The detailed description and enumerated variations, while disclosing optional variations, are intended for purposes of illustration only and are not intended to limit the scope of the invention.

BRIEF DESCRIPTION OF THE DRAWINGS

A more complete understanding of the embodiments, and the attendant advantages and features thereof, will be more readily understood by references to the following detailed description when considered in conjunction with the accompanying drawings wherein.

Figure 1A:
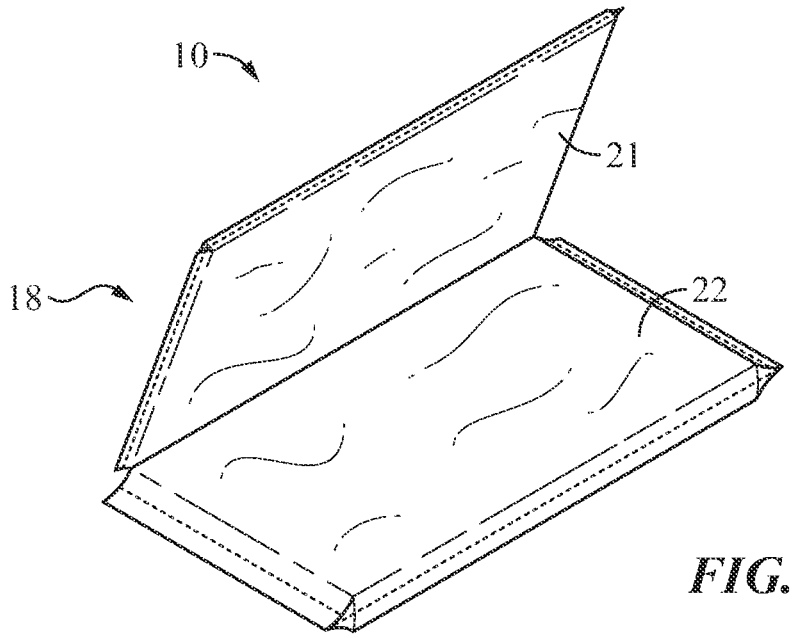
FIG. 1A illustrates a cooling pack of a cooling treatment device, according to some embodiments disclosed herein.

The drawings are not necessarily to scale, and certain features and certain views of the drawings may be shown exaggerated in scale or in schematic in the interest of clarity and conciseness.

DETAILED DESCRIPTION

The specific details of the single embodiment or variety of embodiments described herein are to the described product or methods of use. Any specific details of the embodiments are used for demonstration purposes only and no unnecessary limitations or inferences are to be understood from there.

It is noted that the embodiments reside primarily in combinations of components and procedures related to the products. Accordingly, the product and components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

In general, the embodiments described herein relate to a cooling treatment device. The cooling treatment device can include a cooling pack. The cooling pack can include at least a first cooling material and a second cooling material. The first cooling material and the second cooling material can include water, a thickener (e.g., hydroxyethyl cellulose, sodium polyacrylate, silica gel, carboxymethyl cellulose, or any combination thereof), a freezing point depressant (e.g., propylene glycol, salts), or any combination thereof. In some embodiments, the second cooling material can include a larger amount of the freezing point depressant and/or the thickener than the first cooling material so that the second cooling material is able to stay colder than the first cooling material for a longer period of time. The cooling pack can include a first cooling pack portion (e.g., a first sealed bag containing the first cooling material) and a second cooling pack portion (e.g., a second sealed bag containing the second cooling material).

The cooling treatment device can include a cushion that has at least one cavity for accommodating the cooling pack. The cooling pack can be positioned within the cavity of the cushion during cooling treatment and can be removed for freezing. A user can place the cooling pack in a freezer, wait until the cooling pack reaches a desired low temperature, and return the cooling back to the cavity of the cushion in preparation for cooling treatment.

The cushion can include any suitable cushion for supporting a part of the body during cooling treatment. For example, the cushion can include a pillow such as a head pillow, a neck pillow, a body pillow, a leg pillow, a knee pillow, a wedge pillow, etc. As another example, a suitable cushion can include a seat cushion, a back cushion, an armrest cushion, etc.

The cooling treatment device can include at least one layer of material disposed over the cooling pack and the cavity. The layer of material can be constructed and arranged to be a temperature barrier between the cooling pack and a user during cooling treatment. The layer of material can be made primarily of any suitable material that allows a user to receive cooling treatment over an extended period of time (e.g., one hour, two hours, etc.) without being burned by the cooling pack. For example, the layer of material can be made primarily of silicone. In some embodiments, the layer of material can be made primarily of silicone foam. In some embodiments, the layer of material can be made primarily from gel-infused memory foam, shredded memory foam, latex foam, bamboo-derived fabrics, microfiber cooling fabrics, phase change materials (PCM), polyester fiberfill, cooling gel fibers, or any combination thereof.

Figure 1B:
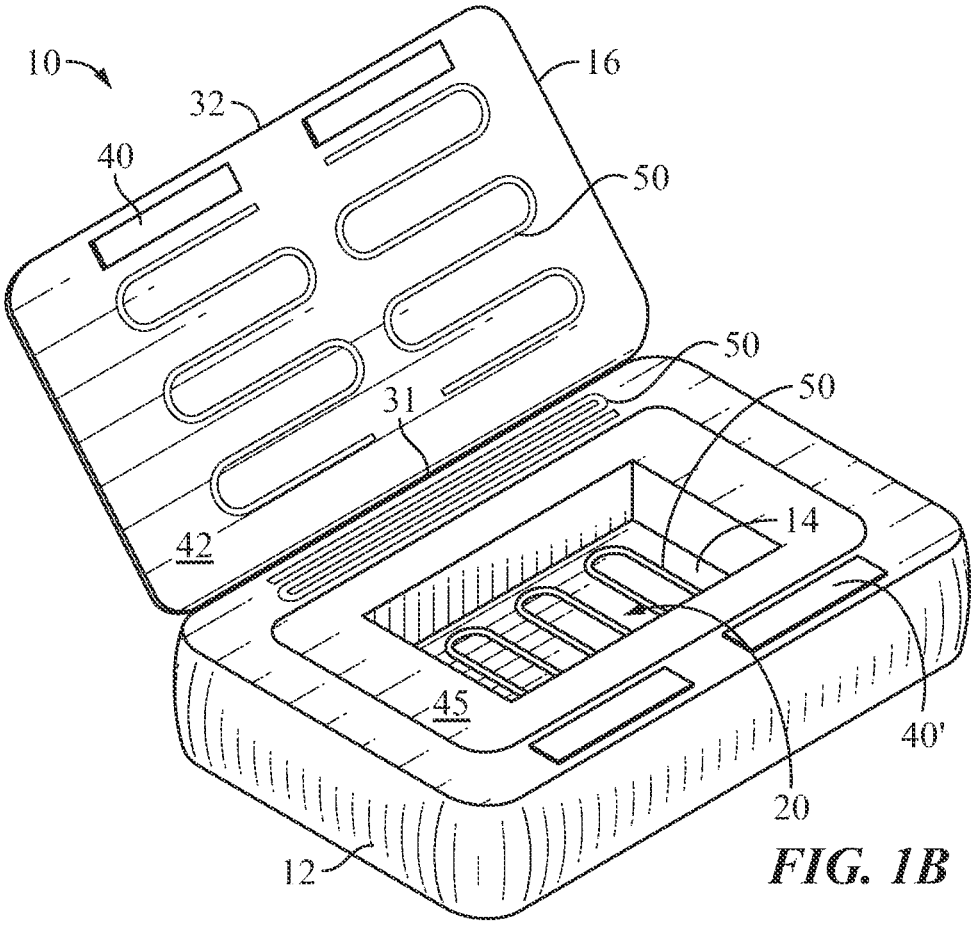
FIG. 1B illustrates a cushion of a cooling treatment device, according to some embodiments disclosed herein.

Referring to FIG. 1A, a device 10 for cooling treatment can include at least one cooling pack 18 that is freezable. Referring to FIG. 1B, in some embodiments, the cooling treatment device 10 can include a cushion 12 that has at least one cavity 14 that is constructed and arranged to accommodate the cooling pack 18 so that the cooling pack 18 can be positioned within the cavity 14. In some embodiments, the cooling pack 18 can be removable from the cavity 14. In some embodiments, a recessed surface 20 of the cushion 12 can at least partially define the cavity 14 of the cushion 12. In some embodiments, the recessed surface 20 can include a moisture wicking material or silicone gel to prevent the cushion 12 from absorbing any moisture condensed on the cooling pack 18 during cooling treatment.

In some embodiments, the cooling treatment device 10 can include at least one layer of material 16 that is constructed and arranged to be a temperature barrier between the cooling pack 18 and a user. In some embodiments, the layer of material 16 can be made primarily of a thermally insulating material (e.g., silicone foam). In some embodiments, the layer of material 16 can be detachable from the cushion 12, and reattachable to the cushion 12. In some embodiments, the layer of material 16 can have at least a first side 31 that is attached to the cushion 12. For example, the first side 31 of the layer of material 16 can be stitched or adhered to the cushion 12.

In some embodiments, the layer of material 16 can have at least a second side 32 opposite the first side 31, wherein the second side 32 is detachable from the cushion 12, and reattachable to the cushion 12. For example, a first set of fasteners 40 can be attached to the bottom surface 42 of the layer of material 16 to fasten the bottom surface 42 of the layer of material 16 to a top cushion surface 45 of the cushion 12. As another example, a second set of fasteners 40' can be attached to the top cushion surface 45 of the cushion 12 to fasten the bottom surface 42 of the layer of material 16 to the top surface 45 of the cushion 12. In some embodiments, the first set of fasteners 40 can be constructed and arranged to engage with the second set of fasteners 40' to fasten the bottom surface 42 of the layer of material 16 to the top cushion surface 45 of the cushion 12. The first set of fasteners 40 and the second set of fasteners 40' can be constructed and arranged to removably attach any portion of the layer of material 16 to the top cushion surface 45 of the cushion 12. The fasteners 40, 40' can be any suitable type of fasteners such as, for example, button fasteners, hook and loop fasteners, zipper fasteners, magnetic fasteners, etc. In some embodiments, the top cushion surface 45 can include a moisture wicking material or silicone gel to prevent the cushion 12 from absorbing any moisture condensed on the cooling pack 18 during cooling treatment.

In some embodiments, the cooling treatment device 10 can include one or more thermal conductors 50 attached to the layer of material 16, the recessed surface 20, and/or the top cushion surface 45. In some embodiments, the one or more thermal conductors 50 can be attached to a bottom surface 42 of the layer of material 16. In some embodiments, a layer of fabric or material can be disposed over the one or more thermal conductors 50 to prevent corrosion. The one or more thermal conductors 50 can be constructed and arranged to dissipate heat from a user along the bottom surface 42 of the layer of material 16.

Figure 1C:
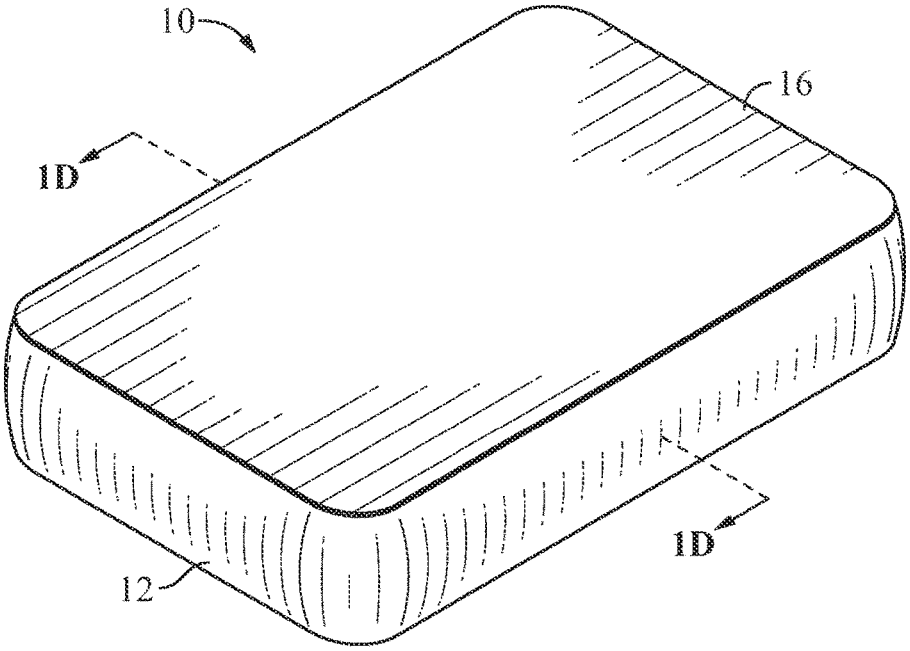
FIG. 1C illustrates a cooling treatment device with the at least one layer of material covering at least a cavity of the cushion, according to some embodiments disclosed herein.
Figure 1D:
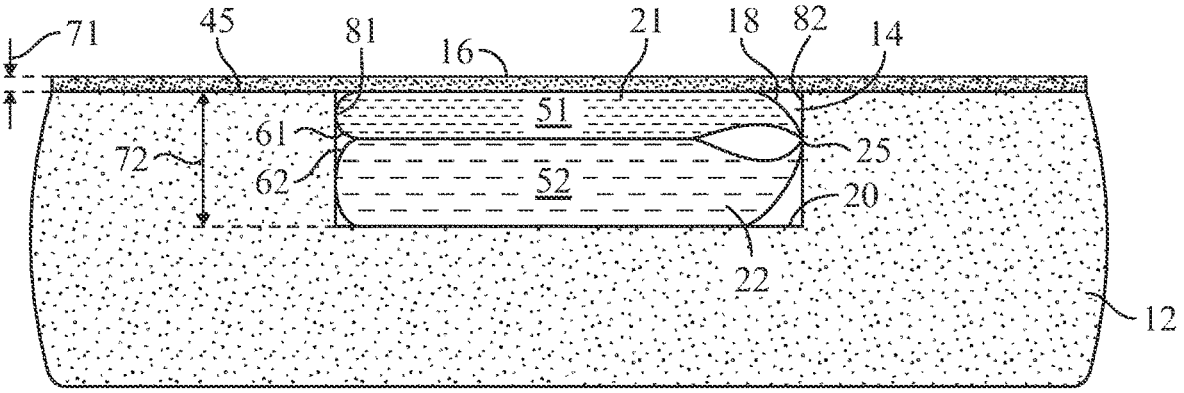
FIG. 1D illustrates a cross-sectional view of the cooling treatment device of FIG. 1C, taken along line 1D-1D in FIG. 1C, according to some embodiments disclosed herein.

Referring to FIG. 1C, the layer of material 16 can be constructed and arranged to cover at least the cavity 14 and the cooling pack 18. Referring to FIG. 1D, the cooling pack 18 can be positioned within the cavity 14. In some embodiments, the layer of material 16 can be disposed over the cooling pack 18 and the cavity 14. In some embodiments, the layer of material 16 can hold the cooling pack 18 in place within the cavity 14 when the layer of material 16 is fastened to the cushion 12. In some embodiments, the layer of material 16 disposed over the cooling pack 18 can have a thickness 71 of at least 3 mm. In some embodiments, the cavity 14 of the cushion 12 can have a depth 72 of at least 12 mm. In some embodiments, sidewalls 81, 82 at least partially defining the cavity 14 can include a moisture wicking material or silicone gel to prevent the cushion 12 from absorbing any moisture condensed on the cooling pack 18 during cooling treatment.

In some embodiments, the cooling pack 18 can include a first cooling pack portion 21 and a second cooling pack portion 22. In some embodiments, the first cooling pack portion 21 can be attached to the second cooling pack portion 22. In some embodiments, the first cooling pack portion 21 can be foldably attached to the second cooling pack portion 22 via a fold 25.

In some embodiments, the first cooling pack portion 21 can contain a first cooling material 51. For example, the first cooling pack portion 21 can include a first sealed bag 61 that contains the first cooling material 51. In some embodiments, the second cooling pack portion 22 can include a second cooling material 52. For example, the second cooling pack portion 22 can include a second sealed bag 62 that contains the second cooling material 52. In some embodiments, the first cooling material 51 can have a first heat capacity (e.g., a first specific heat capacity). In some embodiments, the second cooling material 52 can have a second heat capacity (e.g., a second specific heat capacity). In some embodiments, the second heat capacity can be larger than the first heat capacity so that the second cooling pack portion 22 is able to stay colder than the first cooling pack portion 21 for a longer period of time. During use, the first cooling pack portion 21 and the second cooling pack portion 22 absorb heat from a user. As the second cooling pack portion 22 is positioned under the first cooling pack portion 21, the second cooling pack portion 22 can reduce the rate at which the first cooling pack portion 21 becomes warmer. In some embodiments, the first cooling pack portion 21 is softer than the second cooling pack portion 22, making the first cooling pack portion 21 more comfortable for a user while reducing the rate at which the second cooling pack portion 22 absorbs heat. For example, in some embodiments, the first cooling pack portion 21 has a lower amount of a thickener than the second cooling pack portion 22.

Figure 1E:
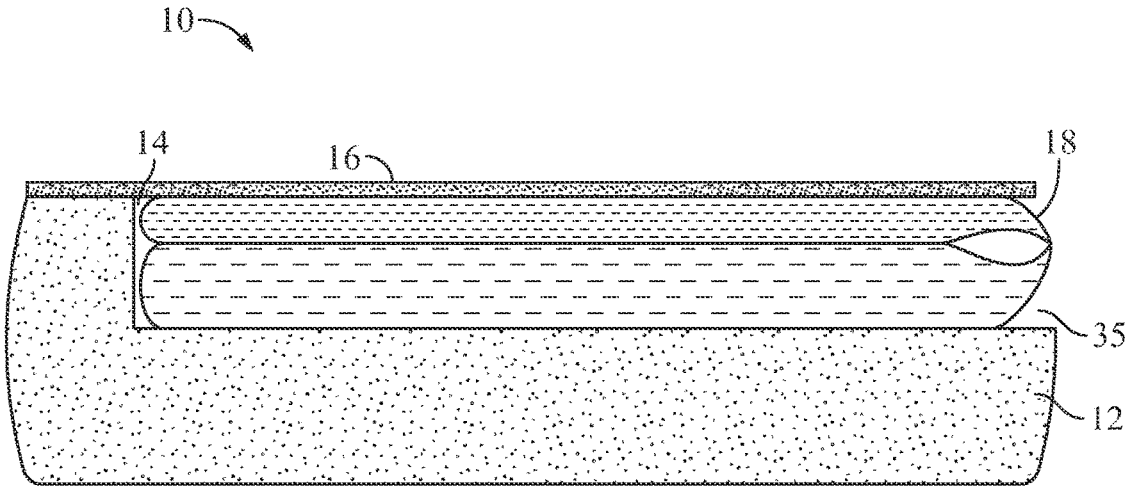
FIG. 1E illustrates a variation of the cooling treatment device shown in FIG. 1D, with the cushion having a side opening, according to some embodiments disclosed herein.

Referring to FIG. 1E, in some embodiments, the cooling pack 18 can be made larger to absorb more heat from a user, and the cavity 14 can be made larger to accommodate the cooling pack 18. In some embodiments, the cooling treatment device 10 can have a side opening 35 between the layer of material 16 and the cushion 12. In some embodiments, the side opening 35 can be sized to receive the cooling pack 18. In some embodiments, the cooling pack 18 can be inserted into the cavity 14 through the side opening 35.

Figure 1F:
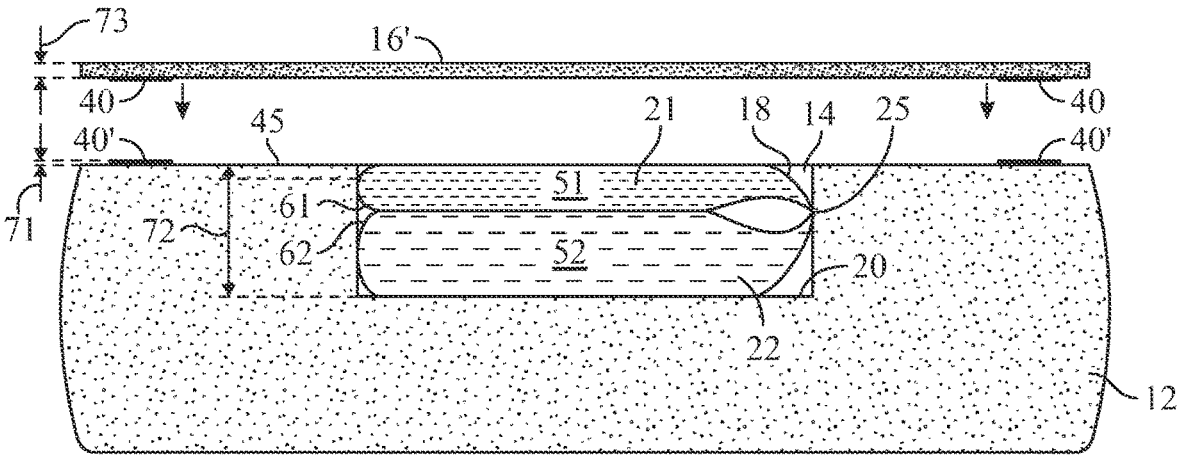
FIG. 1F illustrates a variation of the cooling treatment device shown in FIG. 1D, with a first layer of material removed from the cushion, and with a second layer of material positioned above the cushion, according to some embodiments disclosed herein.
Figure 1G:
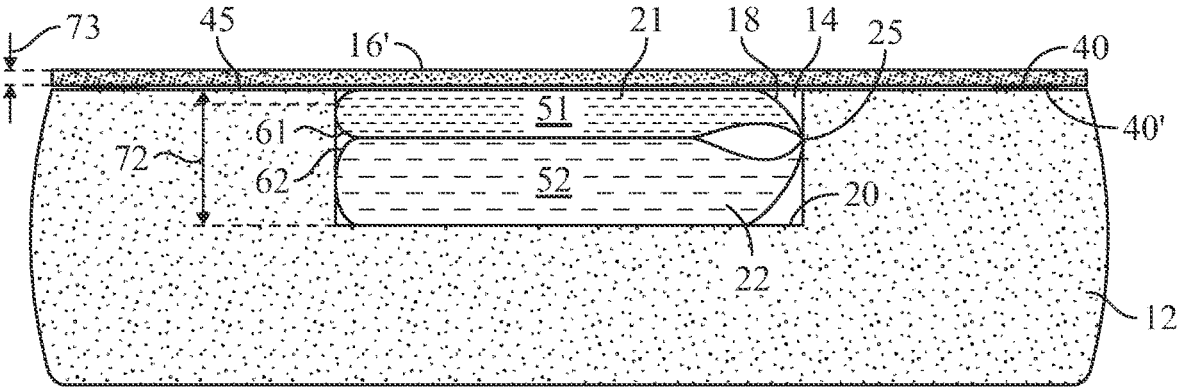
FIG. 1G illustrates a variation of the cooling treatment device shown in FIG. 1D, with a second layer of material attached to the cushion, according to some embodiments disclosed herein.

Referring to FIG. 1F, the layer of material 16 can be removed from the cushion 12, and a second layer of material 16' can be positioned over the cavity 14 and the cooling pack 18. In some embodiments, the second layer of material 16' can have a thickness 73 that is larger than the thickness (e.g., 71 in FIG. 1D) of the layer of material 16 so that the second layer of material 16' can be more thermally insulating than the layer of material 16. Referring to FIG. 1G, the second layer of material 16' can be removably attached to the top cushion surface 45 of the cushion 12 via fasteners 40, 40'.

Figure 2:
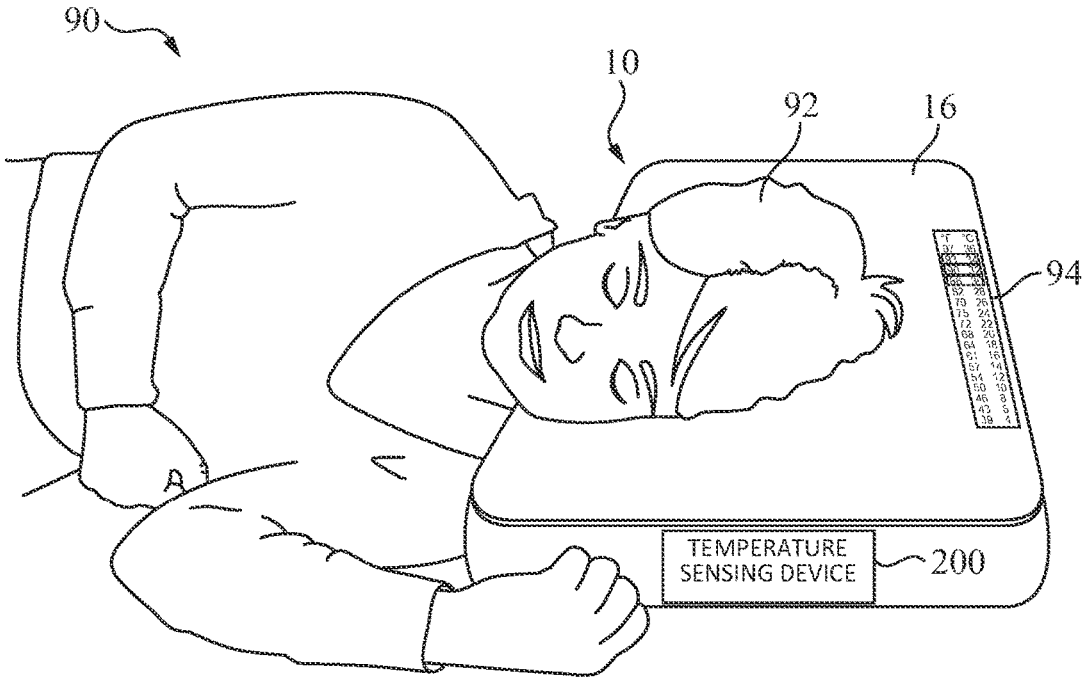
FIG. 2 illustrates a user supporting their head with a cooling treatment device, according to some embodiments disclosed herein.

Referring to FIG. 2, a user 90 can position any part of their body, such as, for example, their head 92 on the cooling treatment device 10. The user 90 may desire to lay their face on the layer of material 16. In some embodiments, the layer of material 16 can create a temperature barrier between the cooling pack (e.g., 18 in FIG. 1D) and the user 90 to extend the time during which the cooling pack 18 is colder than an ambient room temperature. In some embodiments, the layer of material 16 can be hypoallergenic and add comfort to the user 90 supporting their head 92. While FIG. 2 shows the user 90 supporting their head 92 with the cooling treatment device 10, the cooling treatment device 10 can be used to support any part of the user's 90 body such as, for example, their back, leg, arm, knee, foot, etc.

In some embodiments, the cooling treatment device 10 can include a thermometer strip 94 on the layer of material 16. The thermometer strip 94 can be constructed and arranged to indicate a temperature of the layer of material 16. In some embodiments, the cooling treatment device 10 can include a temperature sensing device 200 on the layer of material 16 or the cushion 12, wherein the temperature sensing device 200 is configured at least to measure temperature of the layer of material 16 and/or the cushion 12, and wirelessly send measured temperature data to one or more user devices.

Figure 3:
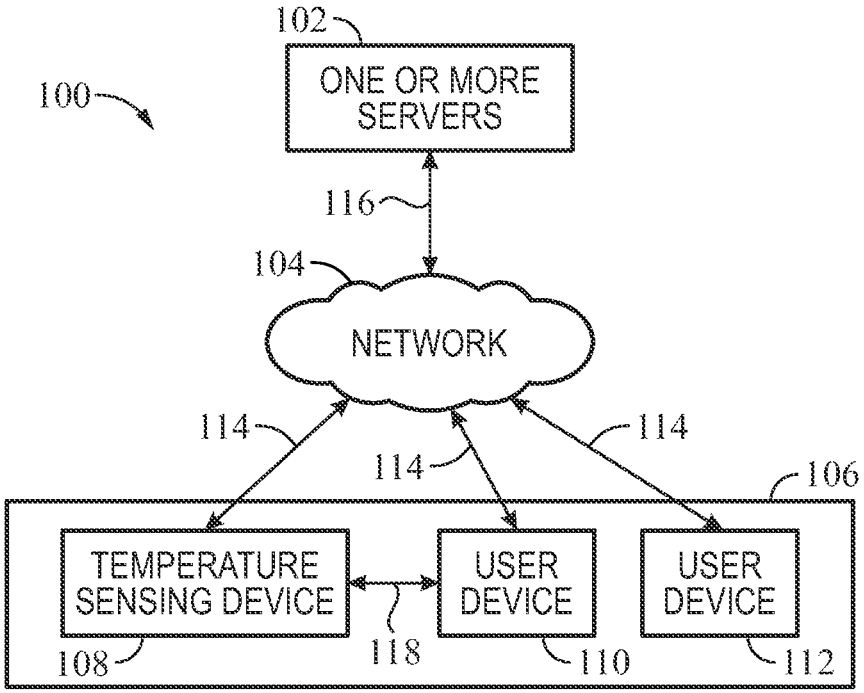
FIG. 3 illustrates a block diagram of a system for measuring temperature of a cooling treatment device, according to some embodiments disclosed herein.

Referring to FIG. 3, a system 100 for monitoring the temperature of the cooling treatment device 10 can be used in some embodiments disclosed herein. In some embodiments, system 100 can comprise one or more servers 102, a network 104 (e.g., communication network), one or more user devices 106, or any combination thereof. In some embodiments, the one or more user devices 106 can include a temperature sensing device 108, a second user device 110, a third user device 112, any other user device(s), or any combination thereof.

The one or more servers 102 can be any suitable server(s) for storing data, programs, or a combination thereof, for measuring temperature of the cooling treatment device 10. In some embodiments, the one or more servers 102 can include one or more computing devices.

In some embodiments, the one or more user devices 106 can include one or more computing devices. The one or more computing devices can include a mobile device, such as a mobile phone, a tablet computer, a wearable computer, a laptop computer, a vehicle (e.g., a car, a boat, an airplane, or any other suitable vehicle), any other suitable mobile device, any suitable non-mobile device (e.g., a desktop computer, entertainment system, etc.), or any combination thereof. As another example, the one or more computing devices can include a media playback device, such as a television, a projector device, a game device or game console, any other suitable computing device, or any combination thereof.

In some embodiments, the one or more user devices 106 can include a temperature sensing device 108 that is configured to at least measure the temperature of the cooling treatment device 10, and wirelessly send temperature data to the one or more servers 102 or any other user device (e.g., 110, 112) proximate to the temperature sensing device 108.

The network 104 can include a wired network, a wireless network, or a combination thereof. In some embodiments, the network 104 can include the Internet, an Internet of Things (IOT) network, an intranet, a wide-area network (WAN), a local-area network (LAN), a digital subscriber line (DSL) network, a frame relay network, an asynchronous transfer mode (ATM) network, a virtual private network (VPN), any other suitable communication network, or any combination thereof. In some embodiments, one or more communications links 114 can connect the one or more user devices 106 to the network 104. In some embodiments, one or more communication links 116 can connect the network 104 to the one or more servers 102. In some embodiments, one or more communications links 118 can connect the temperature sensing device 108 to any of the other one or more user devices 106. The one or more communication links 114, 116, 118 can be any communication links suitable for communicating information between any devices of the one or more user devices 106 and the one or more servers 102, such as, for example, network links, dial-up links, wireless links, hard-wired links, any other suitable communications links, or any combination thereof.

While the one or more servers 102 are illustrated as one device, any suitable number of computing devices can be included in the one or more servers 102 in some embodiments.

While three user devices 108, 110, 112 are illustrated in FIG. 3 to avoid over-complicating the figure, any suitable number of computing devices can be included in the one or more user devices 106 in some embodiments.

In some embodiments, the one or more servers 102, and the one or more user devices 106 can be implemented using any suitable hardware. For example, any device of the one or more servers 102, and the one or more user devices 106 can be implemented using any suitable general-purpose computer or special-purpose computer. Any general-purpose computer or special-purpose computer can include any suitable hardware.

Figure 4:
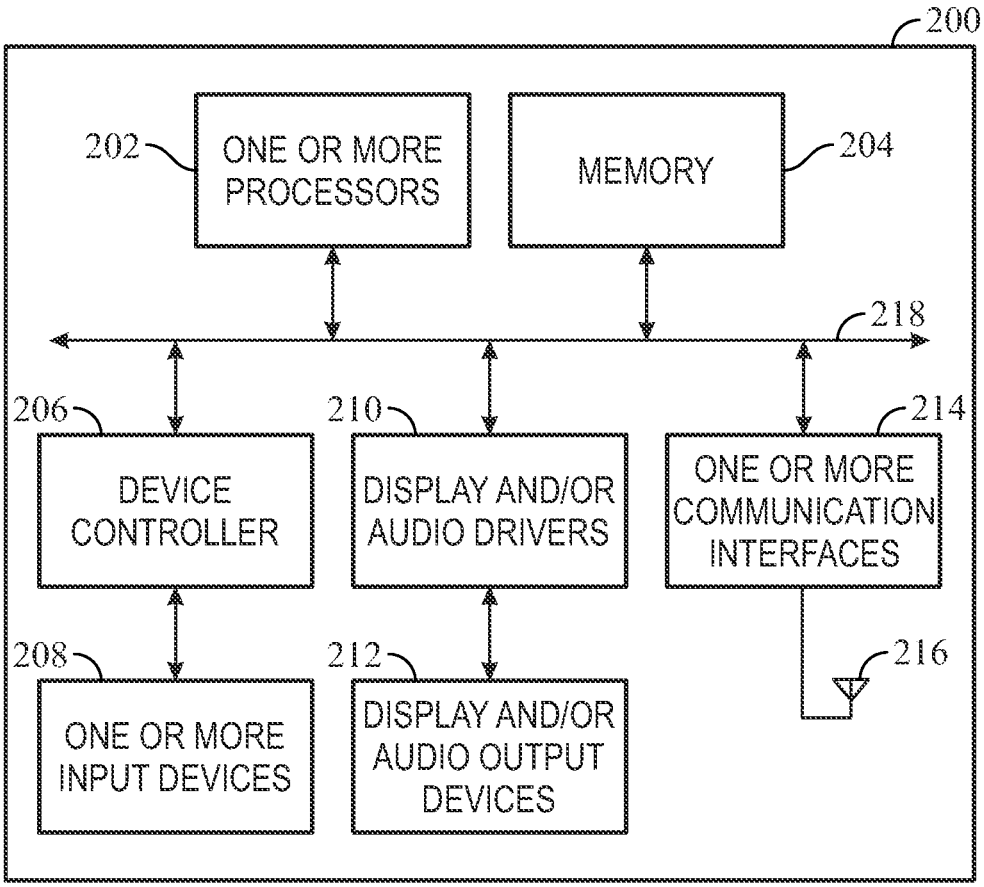
FIG. 4 illustrates a block diagram of hardware of a computing device, according to some embodiments disclosed herein.

Referring to FIG. 4, an example hardware of a computing device 200 is illustrated. In some embodiments, the computing device 200 can include one or more processors 202, memory 204, a device controller 206, one or more input devices 208, display and/or audio drivers 210, display and/or audio output devices 212, one or more communication interfaces 214, one or more antennas 216, a bus 218, or any combination thereof.

In some embodiments, the one or more processors 202 can include any suitable hardware processor, such as a central processing unit (CPU), a graphics processing unit (GPU), a tensor processing unit (TPU), an accelerated processing unit (APU), any other type of processing unit, or any combination thereof. In some embodiments, the one or more processors 202 can include a microprocessor, a microcontroller, a digital signal processor, dedicated logic, an application-specific integrated circuit (ASIC), a field programmable gate array (FPGA), an accelerator (e.g., an artificial intelligence (AI) accelerator or a cryptographic accelerator), any other suitable circuitry for controlling the functioning of a general purpose computer or a special purpose computer, or any combination thereof.

In some embodiments, one or more processors 202 of any user device (e.g., 108, 110, 112 in FIG. 3) of the one or more user devices 106 can be controlled by a computer program stored in memory 204 of the user device. For example, the computer program can cause the one or more processors 202 to measure the temperature of a cooling treatment device 10, and wirelessly send temperature data to the one or more servers 102 or to any other user device (e.g., 110, 112) proximate to the temperature sensing device 108. In some embodiments, the one or more processors 202 can be configured to utilize any suitable machine learning model to monitor and regulate temperature patterns, and suggestions to a user. For example, the one or more processors 202 can identify a plurality of features based on any measured temperature of the cooling treatment device 10. The one or more processors 202 can generate at least one feature vector based at least on the plurality of features identified, and provide the at least one feature vector to a machine learning language model configured to monitor and regulate temperature patterns in the cooling treatment device 10.

In some embodiments, the memory 204 can include any suitable memory, storage, or a combination thereof for storing programs, data, and/or any other suitable information. For example, memory 204 can include volatile memory, non-volatile memory, or any combination thereof. In some embodiments, memory 204 can include random access memory, read-only memory, flash memory, a hard disk drive, a solid state drive, optical media, any other suitable memory, or any combination thereof.

In some embodiments, the device controller 206 can include any suitable processor or circuitry for controlling and receiving any input from the one or more input devices 208. In some embodiments, the one or more input devices 208 can include a touchscreen, a keyboard, a mouse, one or more buttons, a voice recognition circuit, a camera, one or more sensors, a global positioning system (GPS) receiver, any other suitable input device, or any combination thereof. In some embodiments, the one or more sensors can include a temperature sensor that is configured to measure the temperature of a cooling treatment device 10. In some embodiments, the one or more input devices 208 can be included in any device of the one or more servers 102, the one or more user devices 106, or any combination thereof.

In some embodiments, the display and/or audio drivers 210 can include any suitable circuitry for controlling and driving output to one or more display and/or audio output devices 212. For example, the output devices can include a display (e.g., including a touchscreen, a flat-panel display, a cathode ray tube display, a projector, any other suitable display or presentation device, or any combination thereof), one or more speakers, or a combination thereof.

In some embodiments, the one or more communication interfaces 214 can include any suitable circuitry for interfacing with one or more communication networks, such as network 104 as shown in FIG. 3. For example, the one or more communication interfaces 214 can include network interface card circuitry, wired communication circuitry, wireless communication circuitry, any other suitable communication network circuitry, or any combination thereof.

In some embodiments, the one or more antennas 216 can wirelessly communicate with a communication network (e.g., network 104). In some embodiments, the one or more antennas 216 can be omitted.

In some embodiments, the bus 218 can include any suitable communication system for communicating data, addresses, control signals, power, or any combination thereof, between two or more components 202, 204, 206, 210, and 214. In some embodiments, the bus 218 can include any suitable conductors that are constructed and arranged to communicate data, addresses, control signals, power, or any combination thereof, between two or more components 202, 204, 206, 210, and 214.

In some embodiments, any other suitable component(s) can be included in the computing device 200.

The following description of variants is only illustrative of components, elements, acts, products, and methods considered to be within the scope of the invention and are not in any way intended to limit such scope by what is specifically disclosed or not expressly set forth. The components, elements, acts, products, and methods as described herein may be combined and rearranged other than as expressly described herein and are still considered to be within the scope of the invention.

According to variation 1, a device for cooling treatment can include a cooling pack; a cushion including a cavity, the cavity being constructed and arranged to accommodate the cooling pack; at least one reattachable layer of material disposed over the cooling pack and the cavity wherein: the cooling pack is positioned within the cavity; the cooling pack is removable from the cavity; the at least one reattachable layer of material disposed over the cooling pack has a thickness of at least 3 mm; and the cavity of the cushion has a depth of at least 12 mm.

Variation 2 can include the device for cooling treatment of variation 1, wherein: the cooling pack includes a first cooling material; the cooling pack includes a second cooling material; the first cooling material has a first heat capacity; the second cooling material has a second heat capacity; the second heat capacity is larger than the first heat capacity.

Variation 3 can include the device for cooling treatment of variation 1, wherein the cooling pack includes a first cooling pack portion and a second cooling pack portion, wherein the first cooling pack portion is foldably attached to the second cooling pack portion.

Variation 4 can include the device for cooling treatment of variation 1, further comprising: a first set of fasteners attached to a first cushion surface of the cushion; and a second set of fasteners attached to a first surface of the at least one layer of material; wherein the first set of fasteners and the second set of fasteners are constructed and arranged to removably attach the at least one layer of material to the first cushion surface of the cushion.

Variation 5 can include the device for cooling treatment of variation 1, wherein the at least one layer of material is made primarily from gel-infused memory foam, shredded memory foam, latex foam, bamboo-derived fabrics, microfiber cooling fabrics, phase change materials (PCM), polyester fiberfill, cooling gel fibers, or any combination thereof.

Variation 6 can include the device for cooling treatment of variation 1, wherein a recessed surface of the cushion at least partially defines the cavity of the cushion, wherein the recessed surface includes a moisture wicking material or silicone gel.

Variation 7 can include the device for cooling treatment of variation 1, wherein the reattachable layer of material creates a temperature barrier between the cooling pack and a user, is hypoallergenic, adds comfort, and holds the cooling pack in place.

Variation 8 can include the device for cooling treatment of variation 1, further comprising one or more thermal conductors attached to the at least one layer of material, wherein at least one of the one or more thermal conductors is constructed and arranged to interact with (e.g., contact) the cooling pack.

Variation 9 can include the device for cooling treatment of variation 1, further comprising a thermometer strip or a means of sending measured temperature of the cushion to a mobile device or internet of things (IOT) network.

According to variation 10, a device for cooling treatment can include a cooling pack; a cushion including a cavity, the cavity being constructed and arranged to accommodate the cooling pack; at least one layer of material disposed over the cooling pack and the cavity wherein: the cooling pack is positioned within the cavity; the cooling pack is removable from the cavity; the at least one layer of material disposed over the cooling pack has a thickness of at least 3 mm; the cavity of the cushion has a depth of at least 12 mm; the at least one layer of material has a first side that is attached to the cushion; the at least one layer of material has a second side opposite the first side, wherein the second side is constructed and arranged to detach from the cushion; the second side of at least the one layer of material is constructed and arranged to reattach to the cushion.

Variation 11 can include the device for cooling treatment of variation 10, wherein: the cooling pack includes a first cooling material; the cooling pack includes a second cooling material; the first cooling material has a first heat capacity; the second cooling material has a second heat capacity; the second heat capacity is larger than the first heat capacity.

Variation 12 can include the device for cooling treatment of variation 10, wherein the cooling pack includes a first cooling pack portion and a second cooling pack portion, wherein the first cooling pack portion is foldably attached to the second cooling pack portion.

Variation 13 can include the device for cooling treatment of variation 10, further comprising: a first set of fasteners attached to a first cushion surface of the cushion; and a second set of fasteners attached to a first surface of the at least one layer of material; wherein the first set of fasteners and the second set of fasteners are constructed and arranged to removably attach the at least one layer of material to the first cushion surface of the cushion.

Variation 14 can include the device for cooling treatment of variation 10, wherein the at least one layer of material is made primarily from gel-infused memory foam, shredded memory foam, latex foam, bamboo-derived fabrics, microfiber cooling fabrics, phase change materials (PCM), polyester fiberfill, cooling gel fibers, or any combination thereof.

Variation 15 can include the device for cooling treatment of variation 10, wherein a recessed surface of the cushion at least partially defines the cavity of the cushion, wherein the recessed surface includes a moisture wicking material or silicone gel.

According to variation 16, a device for cooling treatment can include a cooling pack; a cushion including a cavity, the cavity being constructed and arranged to accommodate the cooling pack; at least one layer of material disposed over the cooling pack and the cavity wherein: the cooling pack is positioned within the cavity; the cooling pack is removable from the cavity; the at least one layer of material disposed over the cooling pack has a thickness of at least 3 mm; the cavity of the cushion has a depth of at least 12 mm; the at least one layer of material is constructed and arranged to detach from the cushion; the at least one layer of material is constructed and arranged to reattach to the cushion.

Variation 17 can include the device for cooling treatment of variation 16, wherein: the cooling pack includes a first cooling material; the cooling pack includes a second cooling material; the first cooling material has a first heat capacity; the second cooling material has a second heat capacity; the second heat capacity is larger than the first heat capacity.

Variation 18 can include the device for cooling treatment of variation 16, wherein the cooling pack includes a first cooling pack portion and a second cooling pack portion, wherein the first cooling pack portion is foldably attached to the second cooling pack portion.

Variation 19 can include the device for cooling treatment of variation 16, further comprising: a first set of fasteners attached to a first cushion surface of the cushion; and a second set of fasteners attached to a first surface of the at least one layer of material; wherein the first set of fasteners and the second set of fasteners are constructed and arranged to removably attach the at least one layer of material to the first cushion surface of the cushion.

Variation 20 can include the device for cooling treatment of variation 16, wherein the at least one layer of material is made primarily from gel-infused memory foam, shredded memory foam, latex foam, bamboo-derived fabrics, microfiber cooling fabrics, phase change materials (PCM), polyester fiberfill, cooling gel fibers, or any combination thereof.

Many different embodiments have been disclosed herein, in connection with the above description and the drawings. It will be understood that it would be unduly repetitious and obfuscating to describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

An equivalent substitution of two or more elements can be made for anyone of the elements in the claims below or that a single element can be substituted for two or more elements in a claim. Although elements can be described above as acting in certain combinations, and even initially claimed as such, it is to be expressly understood that one or more elements from a claimed combination can, in some cases, be excised from the combination and that the claimed combination can be directed to a subcombination or variation of a subcombination.

It will be appreciated by persons skilled in the art that the present embodiment is not limited to what has been particularly shown and described hereinabove. A variety of modifications and variations are possible considering the above teachings without departing from the following claims.

What is claimed is:

1. A device for cooling treatment, comprising:

a cooling pack;

a cushion including a cavity, the cavity being constructed and arranged to accommodate the cooling pack;

at least one reattachable layer of material disposed over the cooling pack and the cavity wherein:

the cooling pack is positioned within the cavity;

the cooling pack is removable from the cavity;

the at least one reattachable layer of material disposed over the cooling pack has a thickness of at least 3 mm;

the cavity of the cushion has a depth of at least 12 mm; and wherein the cooling pack is configured to cool the cushion when positioned within the cavity and comprises a first cooling pack portion including a first sealed, flexible bag containing a first cooling material and a second cooling pack portion including a second sealed, flexible bag containing a second cooling material, wherein the second cooling material contains a larger amount of a freezing point depressant than the first cooling material such that the second cooling material stays colder than the first cooling material for a longer period of time; and wherein the at least one reattachable layer of material is made primarily of silicone foam constructed and arranged to act as a thermal barrier between the cooling pack and a user so as to permit delivery of cooling treatment over an extended period of time without burning the user's skin.

2. The device for cooling treatment of claim 1, wherein:

the cooling pack includes a first cooling material;

the cooling pack includes a second cooling material;

the first cooling material has a first heat capacity;

the second cooling material has a second heat capacity;

the second heat capacity is larger than the first heat capacity.

3. The device for cooling treatment of claim 1, wherein the cooling pack includes a first cooling pack portion and a second cooling pack portion, wherein the first cooling pack portion is foldably attached to the second cooling pack portion.

4. The device for cooling treatment of claim 1, further comprising:

a first set of fasteners attached to a first cushion surface of the cushion; and a second set of fasteners attached to a first surface of the at least one layer of material;

wherein the first set of fasteners and the second set of fasteners are constructed and arranged to removably attach the at least one layer of material to the first cushion surface of the cushion.

5. The device for cooling treatment of claim 1, wherein the at least one layer of material is made primarily from gel-infused memory foam, shredded memory foam, latex foam, bamboo-derived fabrics, microfiber cooling fabrics, phase change materials (PCM), polyester fiberfill, cooling gel fibers, or any combination thereof.

6. The device for cooling treatment of claim 1, wherein a recessed surface of the cushion at least partially defines the cavity of the cushion, wherein the recessed surface includes a moisture wicking material or silicone gel.

7. The device for cooling treatment of claim 1, wherein the reattachable layer of material creates a temperature barrier between the cooling pack and a user, is hypoallergenic, adds comfort, and holds the cooling pack in place.

8. The device for cooling treatment of claim 1, further comprising one or more thermal conductors attached to the at least one layer of material, wherein at least one of the one or more thermal conductors is constructed and arranged to interact with the cooling pack.

9. The device for cooling treatment of claim 1, further comprising a thermometer strip or a means of sending measured temperature of the cushion to a mobile device or internet of things (IOT) network.

10. A device for cooling treatment, comprising:

a cooling pack;

a cushion including a cavity, the cavity being constructed and arranged to accommodate the cooling pack;

at least one layer of material disposed over the cooling pack and the cavity wherein:

the cooling pack is positioned within the cavity;

the cooling pack is removable from the cavity;

the at least one layer of material disposed over the cooling pack has a thickness of at least 3 mm;

the cavity of the cushion has a depth of at least 12 mm;

the at least one layer of material has a first side that is attached to the cushion;

the at least one layer of material has a second side opposite the first side, wherein the second side is constructed and arranged to detach from the cushion;

the second side of at least the one layer of material is constructed and arranged to reattach to the cushion; and wherein the cooling pack is configured to cool the cushion when positioned within the cavity and comprises a first cooling pack portion including a first sealed, flexible bag containing a first cooling material and a second cooling pack portion including a second sealed, flexible bag containing a second cooling material, wherein the second cooling material contains a larger amount of a freezing point depressant than the first cooling material such that the second cooling material stays colder than the first cooling material for a longer period of time; and wherein the at least one layer of material is made primarily of silicone foam constructed and arranged to act as a thermal barrier between the cooling pack and a user so as to permit delivery of cooling treatment over an extended period of time without burning the user's skin.

11. The device for cooling treatment of claim 10, wherein:

the cooling pack includes a first cooling material;

the cooling pack includes a second cooling material;

the first cooling material has a first heat capacity;

the second cooling material has a second heat capacity;

the second heat capacity is larger than the first heat capacity.

12. The device for cooling treatment of claim 10, wherein the cooling pack includes a first cooling pack portion and a second cooling pack portion, wherein the first cooling pack portion is foldably attached to the second cooling pack portion.

13. The device for cooling treatment of claim 10, further comprising:

a first set of fasteners attached to a first cushion surface of the cushion; and a second set of fasteners attached to a first surface of the at least one layer of material;

wherein the first set of fasteners and the second set of fasteners are constructed and arranged to removably attach the at least one layer of material to the first cushion surface of the cushion.

14. The device for cooling treatment of claim 10, wherein the at least one layer of material is made primarily from gel-infused memory foam, shredded memory foam, latex foam, bamboo-derived fabrics, microfiber cooling fabrics, phase change materials (PCM), polyester fiberfill, cooling gel fibers, or any combination thereof.

15. The device for cooling treatment of claim 10, wherein a recessed surface of the cushion at least partially defines the cavity of the cushion, wherein the recessed surface includes a moisture wicking material or silicone gel.

16. A device for cooling treatment, comprising:

a cooling pack;

a cushion including a cavity, the cavity being constructed and arranged to accommodate the cooling pack;

at least one layer of material disposed over the cooling pack and the cavity wherein:

the cooling pack is positioned within the cavity, the cooling pack is removable from the cavity;

the at least one layer of material disposed over the cooling pack has a thickness of at least 3 mm;

the cavity of the cushion has a depth of at least 12 mm;

the at least one layer of material is constructed and arranged to detach from the cushion;

the at least one layer of material is constructed and arranged to reattach to the cushion; and wherein the cooling pack is configured to cool the cushion when positioned within the cavity and comprises a first cooling pack portion including a first sealed, flexible bag containing a first cooling material and a second cooling pack portion including a second sealed, flexible bag containing a second cooling material, wherein the second cooling material contains a larger amount of a freezing point depressant than the first cooling material such that the second cooling material stays colder than the first cooling material for a longer period of time; and wherein the at least one layer of material is made primarily of silicone foam constructed and arranged to act as a thermal barrier between the cooling pack and a user so as to permit delivery of cooling treatment over an extended period of time without burning the user's skin.

17. The device for cooling treatment of claim 16, wherein:

the cooling pack includes a first cooling material;

the cooling pack includes a second cooling material;

the first cooling material has a first heat capacity;

the second cooling material has a second heat capacity;

the second heat capacity is larger than the first heat capacity.

18. The device for cooling treatment of claim 16, wherein the cooling pack includes a first cooling pack portion and a second cooling pack portion, wherein the first cooling pack portion is foldably attached to the second cooling pack portion.

19. The device for cooling treatment of claim 16, further comprising:

a first set of fasteners attached to a first cushion surface of the cushion; and a second set of fasteners attached to a first surface of the at least one layer of material;

wherein the first set of fasteners and the second set of fasteners are constructed and arranged to removably attach the at least one layer of material to the first cushion surface of the cushion.

20. The device for cooling treatment of claim 16, wherein the at least one layer of material is made primarily from gel-infused memory foam, shredded memory foam, latex foam, bamboo-derived fabrics, microfiber cooling fabrics, phase change materials (PCM), polyester fiberfill, cooling gel fibers, or any combination thereof.

* * * * *